US009435516B2

(12) United States Patent
Sundholm

(10) Patent No.: US 9,435,516 B2
(45) Date of Patent: Sep. 6, 2016

(54) FIXING STRIP FOR A LIGHT-SOURCE BAND

(75) Inventor: Göran Sundholm, Tuusula (FI)

(73) Assignee: MARIMILS OY, Vantaa (FI)

( * ) Notice: Subject to any disclaimer, the term of this patent is extended or adjusted under 35 U.S.C. 154(b) by 227 days.

(21) Appl. No.: 14/131,412

(22) PCT Filed: Jul. 3, 2012

(86) PCT No.: PCT/FI2012/050700

§ 371 (c)(1),
(2), (4) Date: Jan. 7, 2014

(87) PCT Pub. No.: WO2013/007875

PCT Pub. Date: Jan. 17, 2013

(65) Prior Publication Data

US 2014/0140061 A1 May 22, 2014

(30) Foreign Application Priority Data

Jul. 8, 2011 (FI) ..... 20115734

(51) Int. Cl.

| | |
|---|---|
| ***F21S 4/00*** | (2016.01) |
| ***F21V 13/08*** | (2006.01) |
| ***F21V 9/16*** | (2006.01) |
| *F21W 111/00* | (2006.01) |
| *F21Y 101/02* | (2006.01) |
| *F21Y 103/00* | (2016.01) |

(52) U.S. Cl.

CPC ..... *F21V 13/08* (2013.01); *F21S 4/22* (2016.01); *F21V 9/16* (2013.01); *F21W 2111/00* (2013.01); *F21Y 2101/02* (2013.01); *F21Y 2103/003* (2013.01)

(58) Field of Classification Search

CPC ..... F21S 4/00; F21S 9/00; F21S 10/00; F21V 9/16; F21W 2131/00; F21Y 2108/02

USPC ..... 362/249.01, 217.08, 217.09, 217.05, 84

See application file for complete search history.

(56) References Cited

U.S. PATENT DOCUMENTS

| | | | | |
|---|---|---|---|---|
| 6,505,955 | B1 * | 1/2003 | Hatjasalo | B60Q 1/32 264/171.13 |
| 2007/0152808 | A1 * | 7/2007 | LaCasse | G08B 7/062 340/524 |
| 2010/0163897 | A1 | 7/2010 | Hsiao et al. | |
| 2011/0058372 | A1 | 3/2011 | Lerman et al. | |

FOREIGN PATENT DOCUMENTS

| | | | |
|---|---|---|---|
| WO | WO 97/12646 | A1 | 4/1997 |
| WO | WO 2011/029998 | A1 | 3/2011 |

* cited by examiner

*Primary Examiner* — Ali Alavi

(74) *Attorney, Agent, or Firm* — Birch, Stewart, Kolasch & Birch, LLP

(57) ABSTRACT

Fixing strip (1) for a light-source band, which light-source band (100) includes light-emitting light sources (101) and a device for conducting current to the light sources (101), which fixing strip (1) is at least partly transparent and/or photoconductive, and includes a space (2) for at least one light-source band (100). The fixing strip (1) includes a light-storing substance (5), which emits light for at least a certain time after the light sources (101) of the light-source band (100) arranged in the space (2) are not in operation.

20 Claims, 3 Drawing Sheets

FIXING STRIP FOR A LIGHT-SOURCE BAND

The invention relates to illuminated signs and to illuminated sign systems.

The object of the invention is a fixing-strip for a light-source band as defined in the preamble of claim 1.

BACKGROUND OF THE INVENTION

Different systems for guiding, conducting and warning people, e.g. in queuing situations or in situations of danger and accident, such as in fire situations, to the emergency exits of different buildings, tunnels or vessels are known in the art. These are various visual ways to mark the desired routes, such as lightings of emergency exit routes, or otherwise, e.g. emergency exit routes marked with reflective paint or tape.

One prior-art illuminated sign is presented in publication FI108106B. It presents a conductor element, which comprises at least an electrically-conductive elongated conductor part, to which a number of components that are consecutive to each other in the longitudinal direction are fixed, e.g. elements that bring about a lighting function or corresponding. The conductor part and the components are surrounded with an envelope part.

The distinguishing of signs in situations of danger and accident is a problem because the lighting of the signs typically requires electric current and it would be important to distinguish a sign also in situations in which electric current is not available for some reason.

Prior-art solutions also include phosphorized signs. The phosphorized surface radiates light also afterwards, when it is not in the light. This phenomenon is known as phosphorescence. In the phenomenon, a phosphorescent material absorbs electromagnet radiation and emits lower-energy radiation. A phosphorized surface thus emits radiation with a delay, i.e. a surface exposed to visible light incandesces light also in the dark.

In prior-art solutions, phosphorized signs absorb light into themselves from sunlight or from other lighting that is separate and distant from the sign. This light is often not sufficient to illuminate the phosphorized surface adequately enough for the phosphorized surface to illuminate the sign brightly enough for long enough in dark conditions.

In many applications, such as in hotels, passenger ships or tunnels, there are specified emergency exits in emergency situations, which exits people should follow in evacuation circumstances. On the other hand, in a fire situation a pre-defined emergency exit may be impossible owing to the location of the fire, in which case prior-art solutions might direct in the wrong direction or even towards the fire. The sign markings known in the art that are coated with a phosphorized substance are only static signs, and a dynamic control that is distinguished from the static sign cannot be connected to them. Prior-art signs coated with a phosphorized substance do not either function in the type of dark places, in which there is no other lighting, such as e.g. in dark tunnels.

Another problem in prior-art solutions is that a light-source band formed from light sources does not produce an even light.

In some locations certain properties, such as a certain minimum width, is required of the illuminated sign bands fixed to them. Typically light-source bands, which are surrounded by an envelope, are fabricated e.g. in extrusion with the envelope around a light-source band comprising a flexible circuit board, in which case an essentially waterproof structure is achieved for the light-source band. For the purpose of a floor fixing, for example, the fabrication in many different widths of a light-source band intended for conducting people is not technically rational. On the other hand the fixing of a light-source band to a mounting surface, e.g. to a floor or to another place subjected to wear and forces, is often not per se sufficiently strong or durable.

The aim of the invention is to achieve a new type of solution, by means of which the problems of prior art can be avoided. Another aim of the invention is to achieve a versatile fixing solution suited to many different types of light-source bands, by the aid of which the requirements of e.g. a floor fixing are met and which, on the other hand, can be modified according to the requirements of the application.

BRIEF DESCRIPTION OF THE INVENTION

The invention is based on an idea in which a fixing strip is used for the fixing of a light-source band, which fixing strip is at least partly transparent and/or photoconductive and in/on which a light-storing substance is arranged.

The fixing strip for a light-source band according to the invention is mainly characterized by what is disclosed in claim 1.

The fixing strip for a light-source band according to the invention is also characterized by what is disclosed in claims 2-15.

The light-source band system according to the invention is mainly characterized by what is disclosed in claim 16.

The light-source band system according to the invention is also characterized by what is disclosed in claims 17-19.

The solution according to the invention has many important advantages. By means of a fixing strip containing a light-storing substance, the combination of the light-source band and fixing strip is made to be illuminated also for a certain time after the light sources of the light-source band do not emit light, e.g. owing to an electrical outage, because the particles or the surface containing a light-storing substance are illuminated with the light sources that are in connection with the light-source band when the electric current is in use. In this case a more extensive surface than earlier is achieved, if necessary, which is illuminated better than in prior-art solutions. Owing to this an illuminated sign can illuminate more effectively and for longer after the extinguishing of the light sources than in prior-art phosphorized signs or in signs that are illuminated only by means of an electric current. This is of great advantage in the dark, e.g. in emergency exit routes. By arranging light-storing particles or surfaces in/on the fixing strip, the light-source band itself does not need to be modified to include light-storing particles or surfaces. This is also an extremely advantageous solution from the standpoint of manufacturing technique. The fixing strip according to the invention can be advantageously used in connection with many different types of light-source bands. A sufficient width is achieved with the fixing strip so that a low-gradient rise from the fixing surface is achieved in the transverse direction, in which case the light-source band does not need to be embedded. In this case a surface-mounted combination of light-source band plus fixing strip can be crossed easily also by the physically handicapped or by people using walking aids.

In the solution according to the invention the light of the light sources of a light-source band is distinguished from the rest of the sign. By means of this an illuminated sign comprising a fixing strip and a light-source band and provided with a light-storing substance can be made to guide also dynamically, i.e. an impression of movement can be brought about with it, regardless of the light-storing property of the illuminated sign.

Also reflective surfaces can be arranged on a fixing strip, by the aid of which surfaces the light of the light sources of the light-source band can be directed or enhanced.

There can also be a space in the fixing strip for leads, such as e.g. for current conductors or signal conductors.

Since the fixing strip according to the invention also protects the light-source band, the IP (International Protection) protection class requirement of the light-source band against foreign objects, dust, water and humidity can also be reduced by using a fixing strip in the fixing of a light-source band. For example, if without a fixing strip the IP protection class requirement of a light-source band in a certain space is IP68, the IP protection class requirement of the light-source band can be IP 44 when the light-source band is installed by the aid of a fixing strip.

BRIEF DESCRIPTION OF THE FIGURES

In the following, the invention will be described in detail by the aid of some embodiments with reference to the attached drawings, wherein.

DETAILED DESCRIPTION OF THE INVENTION

Figure 1:
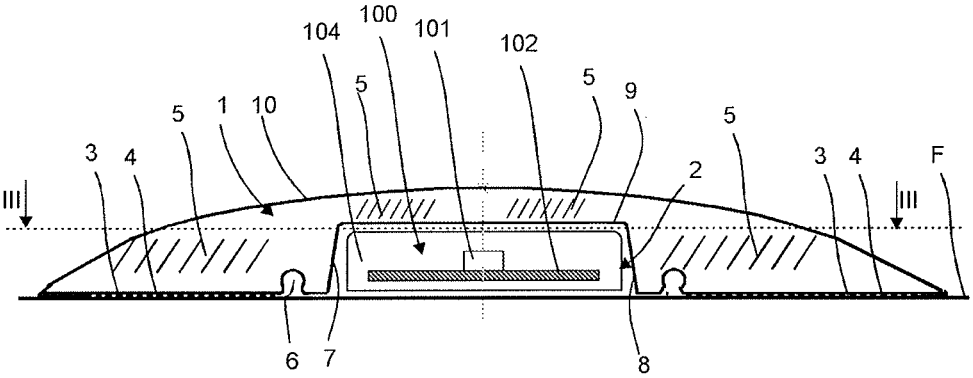
FIG. 1 presents a cross-section of a fixing strip of a light-source band according to the invention, when it is installed.

FIG. 1 presents a cross-section of a fixing strip 1, according to the invention, for a light-source band and of a light-source band 100 installed on a mounting surface F, such as on a floor, wall or ceiling. In the embodiment of the figure, the light-source band 100 comprises a circuit board 102, to which light sources 101 are connected. An elastic and thin circuit board can be used as the circuit board 102. The light sources 101 can be semiconductor light sources, e.g. LED light sources.

Figure 2:
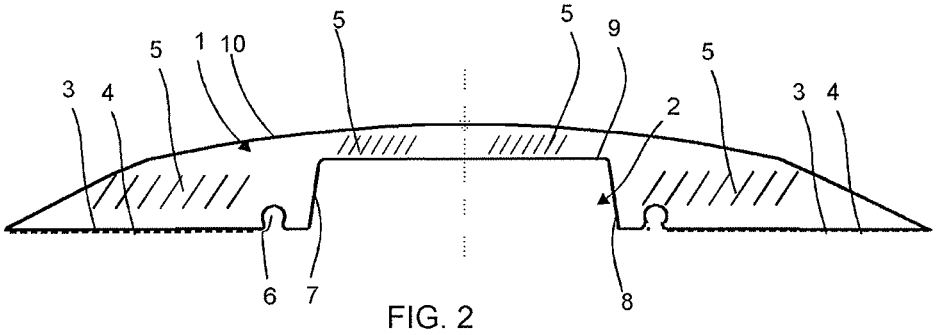
FIG. 2 presents a cross-section of a fixing strip of a light-source band according to the invention.

The fixing strip 1 for a light-source band comprises a space 2 for the light-source band, which space 2 for the light-source band is formed in FIGS. 1 and 2 of a recess extending upwards in the figure from the bottom surface 3 of the fixing strip 1. The space 2 has side walls 7, 8, which in the embodiment of FIGS. 1 and 2 are formed to become to some extent closer to each other when going towards the top wall 9 of the space 2. The fixing strip 1 has an outer surface 10. The fixing strip comprises a fixing point 4, on which is arranged a fixing substance, such as glue, or a fixing means, such as double-sided tape, with which the fixing strip is fixed to the mounting surface F. In FIGS. 1 and 2, the fixing points are arranged on the bottom surface 3 of the fixing strip 1 symmetrically on opposite sides of the space 2 intended for a light-source band.

A light-storing substance 5 is arranged in/on the fixing strip 1. The substance absorbs the light emitted by the light sources 101 into itself. After this, the light-storing substance emits the light. The light-storing substance can be arranged evenly in/on the fixing strip or it can be arranged in some point in/on the fixing strip or on one or more of the surfaces 1, 3, 7, 8, 9 of the fixing strip.

The light-storing substance 5 can contain particles, which are arranged distributed on the length and/or the cross-section of the fixing strip. By the aid of a fixing strip 1 comprising a light-storing substance 5, significantly better illumination properties by volume can be achieved for the light-storing substance compared to a situation in which the light-storing substance is arranged e.g. only in a typically narrow light-source band.

In the embodiment of FIG. 1, the circuit board 102 and the light sources 101 are fitted inside a one-piece envelope part 104. Since the envelope part 104 is one-piece, the structure of the light-source band 100 is waterproof. Plastic or some other corresponding material, for example, can be used as the material of the envelope part 104.

In one embodiment of the invention surfaces containing a light-storing substance and/or an essentially mirror-like material can be formed on/in the fixing strip. A surface that contains a light-storing substance and/or an essentially mirror-like material can also be arranged in connection with the fixing strip, on its interior or on its exterior.

In one embodiment of the invention a surface containing a light-storing substance can be formed by painting any of the surfaces of the fixing strip of the light-source band with paint containing a light-storing substance. The light-storing substance can also be at least partly transparent.

A surface containing a light-storing substance can be phosphorized or treated with some other similar substance that stores within itself the light emitted by the light sources.

The light sources 101 of a light-source band 100 can be arranged such that they are directed directly towards the top surface of the light-source band 100, in which case most of the light is guided directly to above the fixing strip 1. In this case also some of the light emitted by the light sources 101 is funneled to the sides of the light sources. A number of light sources 101 can also be fitted side-by-side on a light-source band 100. The light sources 101 can also be of different colors.

The structure presented by FIG. 1 can be used e.g. as the structure of an elongated light-source band. The light-source band can be formed from light sources placed one after the other, which light sources are arranged e.g. in the manner presented in FIG. 1 inside an elongated envelope part. The structure of the light-source band can be elastic. A light-source band can be installed e.g. on floors and in rooms that people use when exiting from emergency situations or in which people are otherwise conducted. A light-source band can be installed on the horizontal plane, i.e., as is presented in FIG. 1.

Figure 3:
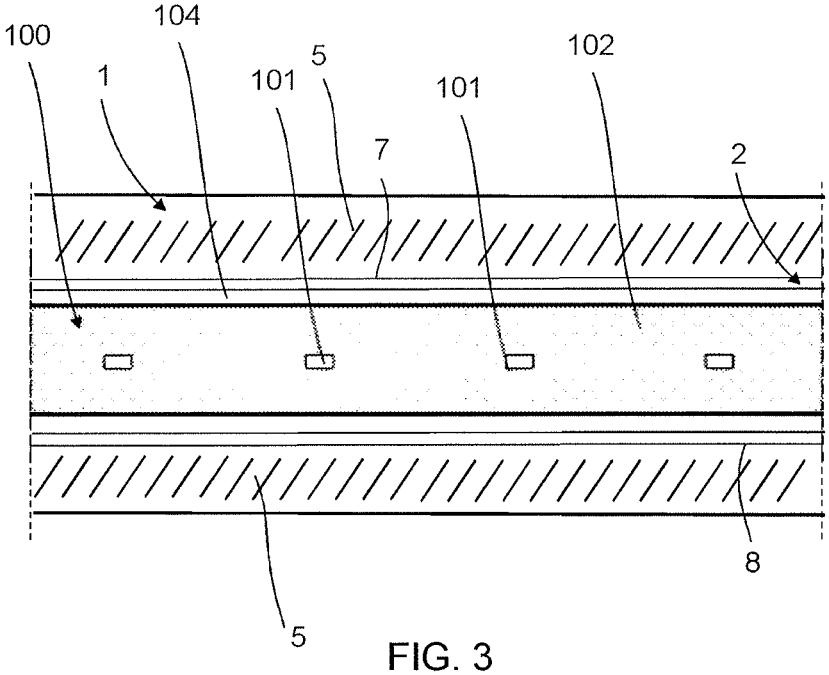
FIG. 3 presents a fixing strip of a light-source band according to the invention from the direction of the line III-III of FIG. 1.

FIG. 3 presents a simplified top view of a combination of a light-source band 100 and a fixing strip according to the invention, sectioned along the line of FIG. 1. The light-source band 100 comprises consecutive or adjacent light sources 101 arranged on a circuit board 102. The fixing strip has a space 2 for the light-source band. In/on the fixing strip is a light-storing substance 5, which is generally marked in the figures with oblique slashes. According to one embodiment the light-storing substance 5 is e.g. mixed in the manufacturing phase into the plastic material from which the fixing strip is fabricated. A light-storing substance can also be arranged on suitable surfaces of the fixing strip.

According to one embodiment of the invention the fixing strip can comprise areas in which is a reflective substance or which comprise an essentially mirror-like material.

The fixing strip can also be colored with the desired color or formed from a material of the desired color.

In one embodiment of the invention the light sources of a light-source band 100 can be lighted or extinguished singly or in groups. A light-source band 100 can e.g. "run" light, i.e. an individual light source 101 can be lit when the adjacent light source 101 extinguishes and is extinguished when the adjacent light source 101 on the same or on the other side lights up. All the light sources 101 of a light-source band 100 can also be lighted and extinguished at one time and this function can be repeated. Flashing of the illuminated sign is achieved with this, which flashing can fasten people's attention on the illuminated sign better than a sign that is continuously illuminated with light sources.

By means of the fixing strip 1 that contains a light-storing substance the light-source band 100 or the patterning of an illuminated sign can be made visible also for a set time after the light sources 101 have been extinguished or have extinguished, e.g. owing to an electrical outage. The duration of visibility of the illuminated sign after the extinguishing of the light sources depends on the materials used and on the efficiency of the light sources of the illuminated sign.

The period of time when an illuminated sign can be seen in the dark can be e.g. approx. 1-2 hours.

FIGS. 4A-4F present the fixing according to one embodiment of the invention of a light-source band 100 by the aid of a fixing strip 1 to a mounting surface F. The fixing strip comprises two fixing points 4, on which is arranged a fixing substance, such as glue, or a fixing means, such as double-sided tape, with which the fixing strip 1 is fixed to the mounting surface F. The mounting surface can be e.g. a wall, a floor or a ceiling. The cover of the double-sided tape can be the cover 40 of the fixing point, e.g. protective plastic or protective paper.

Figure 4F:
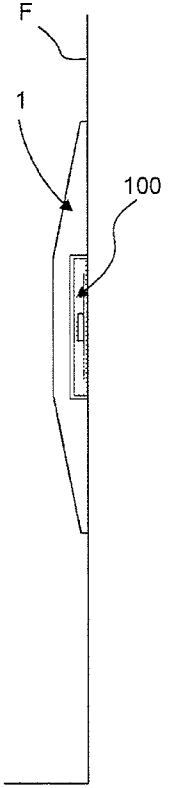
FIGS. 4A-4F present the installation to the mounting surface of a fixing strip of a light-source band according to the invention.
Figure 4E:
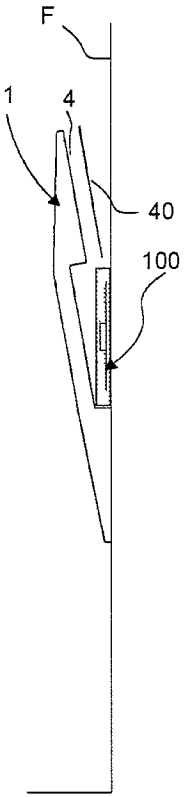
Figure 4D:
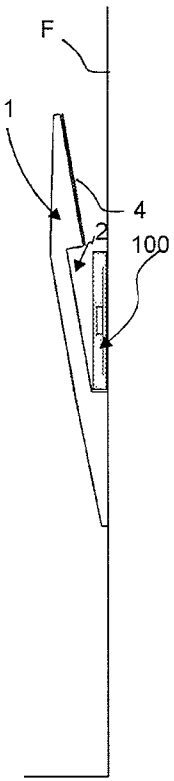
Figure 4C:
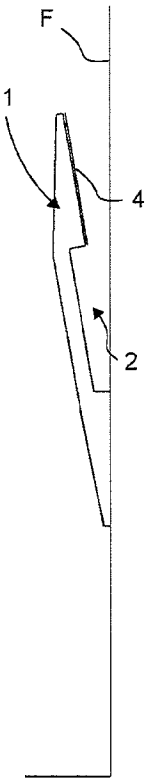
Figure 4B:
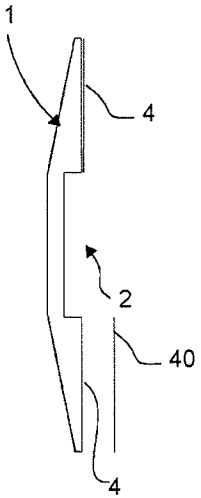
Figure 4A:
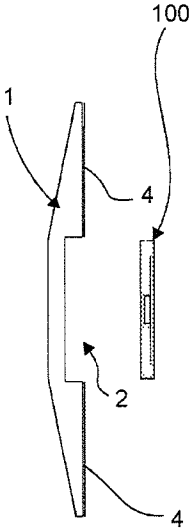

FIG. 4A shows a light-source band 100 and a fixing strip 1 as separate parts before installation. For the installation, the first cover 40 of the fixing point is removed. This is presented in FIG. 4B. When the first cover 40 of the fixing point has been removed, the first fixing point of the fixing strip 100 can be fixed to the mounting surface by the aid of the first fixing point according to FIG. 4C. The light-source band 100 does not yet in this phase need to be in position in the space 2 of the fixing strip. Since the fixing strip 1 is fixed to the surface F only from one side, e.g. from the bottom, the light-source band 100 can be installed into position in the space 2 according to FIG. 4D after the fixing of the first fixing point. When the light-source band 100 is installed into the space 2, the cover 40 of the second fixing strip 1 can also be removed according to FIG. 4E. After this also the second fixing point can be fixed to the wall, in which case the light-source band 100 is fixed to the wall by the aid of the fixing strip 1 according to FIG. 4F.

According to a second embodiment of the invention both the fixing points 4 can be fixed to the mounting surface simultaneously.

In one embodiment of the invention, the fixing strip can form different shapes and the shape of a fixing strip can form e.g. an angle, in which case it can be installed over a corner of the walls, ceiling or floor. The fixing strip can also form in its shape various joint fixing parts, by the aid of which the fixing strips of a light-source band can be fixed to each other.

In one embodiment of the invention the fixing strip does not comprise a light-storing substance.

According to one embodiment of the invention an illuminated sign system can be formed by means of one or more illuminated sign according to the invention and a control device. By means of the control device of the illuminated sign system the illuminated signs of the system or the individual light sources can be controlled. The control device of the system can be disposed in connection with an illuminated sign or it can be separate from the illuminated sign or the illuminated signs operating at the end of a wireline or wireless connection. One control device can control one or more illuminated signs. A control device can also be connected to just one illuminated sign, which conducts or conveys control information to the other illuminated signs of the system. A light-source band, for example, can be used as an illuminated sign.

An illuminated sign and an illuminated sign system can have different modes, e.g. static and dynamic modes. In the static mode all the light sources 101 of an illuminated sign can be on continuously. In the dynamic mode the light sources 101 of illuminated signs can be extinguished and lit in a predetermined manner. By extinguishing and lighting the light sources 101, an impression of movement can be brought about. In this case people can be guided with light sources 101 being lit and extinguished in a predefined manner, e.g. in the direction of travel of the "movement" of the light sources. Typically the impression of movement is brought about by controlling the light sources 101 in groups, in which movement is indicated by lighting the next light source and correspondingly extinguishing the previous one. All the light sources 101 of a certain illuminated sign or a number of illuminated signs can also be lit at one time and extinguished after this. When this function is repeated, flashing of the illuminated sign is achieved, which can fasten people's attention on the illuminated sign better than a static mode.

In one embodiment of the invention the system can light or extinguish the individual light sources of an individual illuminated sign. The light sources can also be lit or extinguished in groups.

An illuminated sign system can be used e.g. in connection with a queuing control system, a traffic control system, an emergency exit control system, an evacuation system or a fire alarm system and the control system of the systems in question can control the control device or illuminated signs of the illuminated sign system.

The invention thus relates to a fixing strip 1 for a light-source band 100, which light-source band 100 comprises light-emitting light sources 101 and means for conducting current to the light sources 101, which fixing strip 1 is at least partly transparent and/or photoconductive, and comprises a space 2 for at least one light-source band 100.

According to one preferred embodiment the fixing strip 1 comprises a light-storing substance 5, which emits light for at least a certain time after the light sources 101 of the light-source band 100 arranged in the space 2 are not in operation.

According to one preferred embodiment the fixing strip 2 covers the light-source band 100 at least partly.

According to one preferred embodiment the light-storing substance 5 comprises light-storing particles.

According to one preferred embodiment the light-storing particles are arranged evenly distributed in/on the fixing strip 1.

According to one preferred embodiment the light-storing particles 5 are arranged in certain points in/on the fixing strip 1.

According to one preferred embodiment the fixing strip 1 is configured to be used with a light-source band 100, the conductor means or circuit board 102 and light sources 101 of which are surrounded with an envelope part 104.

According to one preferred embodiment the fixing strip 1 is an elongated flexible strip.

According to one preferred embodiment the fixing strip 1 is configured for fixing to a mounting surface F, more particularly to a floor surface, wall surface or ceiling surface.

According to one preferred embodiment the fixing strip 1 comprises a fixing surface 4, which is provided with, or can be provided with, a fixing substance, such as glue, or with a fixing means, such as tape.

According to one preferred embodiment the fixing strip 1 is configured to be used with a light-source band 100, in which the light sources 101 are arranged consecutively and/or adjacently.

According to one preferred embodiment a light-storing substance is arranged in/on the fixing strip 1 in the proximity of at least a part of the light sources 101 of a light-source band 100.

According to one preferred embodiment the light-storing substance is phosphorus.

According to one preferred embodiment a reflective surface, such as a mirror surface, is arranged on the fixing strip 1.

According to one preferred embodiment the fixing strip 1 is in connection with a light-source band 100, which is used to conduct, to warn or to guide people, e.g. in connection with a queuing system, a traffic control system, an emergency exit control system, an evacuation system or a fire alarm system.

According to one preferred embodiment the fixing strip 1 also has a placement location 6 for at least one conductor.

The invention also relates to a light-source band system, which is composed of at least one light-source band 100. In the system a fixing strip 1 for a light-source band according to any of claims 1-15 is used.

According to one preferred embodiment in the system the control unit is fitted to light and to extinguish one at a time in a predetermined manner the light sources 101 of one light-source band 100.

According to one preferred embodiment in the system the control information is brought to the light-source band 100 wirelessly or by wireline.

According to one preferred embodiment the light-source band 100 is controlled by a queue control system, a traffic control system, an emergency exit control system, an evacuation system or a fire alarm system.

It is obvious to the person skilled in the art that the invention is not limited to the embodiments presented above, but that it can be varied within the scope of the claims presented below. The characteristic features possibly presented in the description in conjunction with other characteristic features can also, if necessary, be used separately to each other.

The invention claimed is:

1. A fixing strip for a light-source band for fixing a light-source band, which light-source band comprises light-emitting light sources and means for conducting current to the light sources, which fixing strip is at least partly transparent or photoconductive, and comprises a space for at least one light-source band, wherein the space for the light-source band is formed of a recess extending upwards from the bottom surface of the fixing strip, and the fixing strip is configured for surface-mounted fixing to a mounting surface (F), wherein the mounting surface is a floor surface wall surface or ceiling surface.

2. The fixing strip for a light-source band according to claim 1, wherein the fixing strip comprises a light-storing substance, which emits light for at least certain time after the light sources of the light source band arranged in the space are not in operation.

3. The fixing strip for a light-source band according to claim 2, wherein the light-storing substance comprises light-storing particles.

4. The fixing strip for a light-source band according to claim 3, wherein the light-storing particles are arranged evenly distributed in/on the fixing strip.

5. The fixing strip for a light-source band according to claim 3, wherein the light-storing particles are arranged in certain points in/on the fixing strip.

6. The fixing strip for a light-source band according to claim 1, wherein the fixing strip covers the light-source band at least partially.

7. The fixing strip for a light-source band according to claim 1, wherein the fixing strip is configured to be used with the light-source band, the conductor means or circuit board and the light sources of which are surrounded with an envelope part.

8. The fixing strip for a light-source band according to claim 1, wherein the fixing strip is an elongated flexible strip.

9. The fixing strip for a light-source band according to claim 1, wherein the fixing strip comprises a fixing surface, which is adapted to be provided with a fixing substance.

10. The fixing strip for a light-source band according to claim 1, wherein the fixing strip is configured to be used with the light-source band, in which the light sources are arranged consecutively or adjacently.

11. The fixing strip for a light-source band according to claim 1, wherein a light-storing substance is arranged in/on the fixing strip in the proximity of at least a part of the light sources of the light-source band.

12. The fixing strip for a light-source band according to claim 1, wherein the light-storing substance is phosphorus.

13. The fixing strip for a light-source band according to claim 1, wherein a reflective surface, is arranged on the fixing strip.

14. The fixing strip for a light-source band according to claim 1, wherein the fixing strip is connected with the light-source band, which is used to conduct, to warn or to guide people in connection with a queuing system, a traffic control system, an emergency exit control system, an evacuation system or a fire alarm system.

15. The fixing strip for a light-source band according to claim 1, wherein the fixing strip also has a placement location for at least one conductor.

16. A light-source band system, which is composed of at least one light-source band, wherein in the system uses a fixing strip according to claim 1.

17. The light-source band system according to claim 16, wherein a control unit is adapted to light and to extinguish, one at a time in a predetermined manner, the light sources of one light-source band.

18. The light-source band system according to claim 17, wherein control information is brought to the light-source band wirelessly or by wireline.

19. The light-source band system according to claim 16, wherein the light-source band is controlled by a queue control system, a traffic control system, an emergency exit control system, an evacuation system or a fire alarm system.

20. A fixing strip for a light-source band which is at least partially transparent or photoconductive, said fixing strip comprising:

an upper outer surface, a bottom surface and a space for accommodating the light-source band, said space defined by a recess extending upwards from the bottom surface of the fixing strip, said bottom surface adapted to accommodate a fixing substance for fixing the fixing strip to a surface, and a light-storing substance disposed on the fixing strip for emitting light for a period of time after the light-source band is not in operation.

* * * * *